United States Patent [19]

Gospodar

[11] 4,090,481

[45] May 23, 1978

[54] THROTTLE CLOSING MECHANISM FOR INTERNAL COMBUSTION ENGINE

[75] Inventor: Reinhard Gospodar, Wolfsburg, Germany

[73] Assignee: Volkswagenwerk Aktiengesellschaft, Germany

[21] Appl. No.: 743,916

[22] Filed: Nov. 22, 1976

[30] Foreign Application Priority Data

Nov. 29, 1975 Germany ..... 2553894

[51] Int. Cl.[2] ..... F02D 11/08

[52] U.S. Cl. ..... 123/103 E; 123/198 DC; 123/DIG. 11

[58] Field of Search ..... 123/103 E, 198 DB, 198 DC, 123/DIG. 11

[56] References Cited

U.S. PATENT DOCUMENTS

| | | | |
|---|---|---|---|
| 3,736,915 | 6/1973 | Dickensheets et al. | 123/DIG. 11 |
| 3,805,760 | 4/1974 | Yagi et al. | 123/DIG. 11 |
| 3,838,674 | 10/1974 | Remaud | 123/198 DB |

FOREIGN PATENT DOCUMENTS

| | | | |
|---|---|---|---|
| 1,242,337 | 8/1960 | France | 123/103 E |
| 2,358,791 | 5/1974 | Germany | 123/DIG. 11 |

*Primary Examiner*—Charles J. Myhre
*Assistant Examiner*—Craig R. Feinberg
*Attorney, Agent, or Firm*—Brumbaugh, Graves, Donohue & Raymond

[57] ABSTRACT

A throttle closing mechanism for an internal combustion engine makes use of a throttle closer which is moveable into and out of a position wherein the closer engages the throttle linkage. An electromagnet is arranged to retain the throttle closer in the linkage engaging position when the ignition switch is on. When the ignition is disconnected, the closing mechanism moves out of the linkage engaging position, thereby facilitating complete closing of the throttle flap and preventing engine run-on.

6 Claims, 1 Drawing Figure

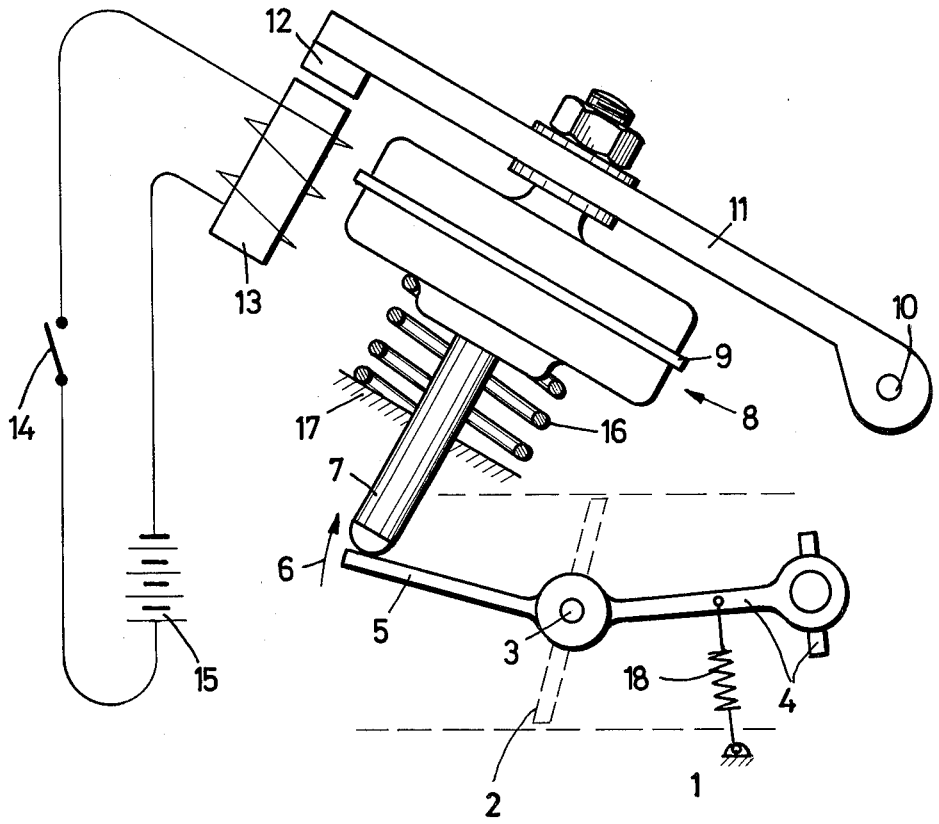
12
11
13
10
9
14
17
16
8
7
6
5
3
18
4
15
2
1

THROTTLE CLOSING MECHANISM FOR INTERNAL COMBUSTION ENGINE

BACKGROUND OF THE INVENTION

This invention relates to mechanisms for closing the throttle flap of an internal combustion engine. Throttle closing mechanisms usually make use of a diaphragm arranged inside a pot-shaped housing. Air flow between the chambers on either side of the diaphragm is restricted by a small opening. When the throttle is released, a plunger connected to the diaphragm prevents rapid closing of the throttle flap, which might cause the engine to stall.

While the slow closing effect provided by the diaphragm is desirable during normal operation of the engine, a rapid closing of the throttle flap is desired when the engine ignition switch is shut off to prevent engine "dieseling" or "run-on". A prior art solution to the run-on problem makes use of a magnetically activated diaphragm by-pass valve which vents the chambers on opposite sides of the diaphragm when the ignition switch is shut off, thereby to effect rapid closing of the throttle flap. When the ignition switch is turned on, an electromagnet closes the by-pass valve thereby effecting normal operation of the throttle closer.

The prior art solution to the run-on problem requires the use of an electromagnetically activated pneumatic valve and tubes connecting the closer chambers to the valve. In addition to the added expense of the pneumatic valve and tubes, this prior art mechanism is subject to malfunctioning, particularly after long use in the environment of an internal combustion engine. The by-pass valve and connecting tubes may become inoperative due to the accumulation of dirt. In this case, leaks will develop so that the throttle closing mechanism is ineffective not only when the ignition is turned off, as is desired, but also when the ignition is on, as is undesired.

It is therefore an object of the present invention to provide a new and improved throttle closing mechanism which effectuates complete closing of the throttle flap when the ignition is turned off.

It is a further object of the invention to provide such a mechanism with simple and low-cost construction.

It is a still further object of the invention to provide such a mechanism which is not subject to wearing out after long use in the environment of an internal combustion engine.

SUMMARY OF THE INVENTION

In accordance with the invention there is provided a throttle closing mechanism for use in conjunction with an internal combustion engine having an ignition switch. The mechanism includes throttle linkage connected to a throttle flap and moveably mounted with respect to the engine to open and close the throttle flap. A throttle closer is mounted to the engine and moveable into and out of a position wherein the closer engages the linkage prior to the closing of the flap. Finally, there is provided an electromagnet, activated by the ignition switch, for holding the throttle closer in the linkage engaging position.

In a preferred embodiment, the throttle closer is mounted to a bracket which is pivoted at one end and engages the electromagnet at the opposite end. There may be provided a spring urging the closer out of the linkage engaging position when the electromagnet is deactivated. The spring may be the same spring which is used for closing of the throttle. The force of the electromagnet may be sufficient only to retain the throttle closer in the linkage engaging position, if the throttle closer is arranged to move into that position upon the opening of the throttle.

For a better understanding of the present invention, together with other and further objects, reference is made to the following description, taken in conjunction with the accompanying drawing, and its scope will be pointed out in the appended claims.

BRIEF DESCRIPTION OF THE DRAWING

The FIG. illustrates a throttle closing mechanism in accordance with the present invention.

DESCRIPTION OF THE INVENTION

For purposes of simplicity only pertinent portions of an internal combustion engine are illustrated in the figure. The closing mechanism of the figure is used in conjunction with a throttle flap 2 which is arranged within an air intake passage 1, which may be the throat of a carburetor. In accordance with the usual arrangement, flap 2 is pivotably mounted on an axis 3 and connected to throttle linkage 4, which may be connected to a gas pedal in a manner which is not germane to the present invention.

Linkage 4 includes an extending arm 5 which is designed to engage a throttle closing mechanism. As throttle flap 2 enters its closed position, arm 5 of the throttle linkage moves in an arcuate direction indicated by arrow 6. A throttle closer 8, which is of conventional design, includes plunger 7 and a diaphragm (not shown) arranged along the center 9 of a pot-shaped housing. Throttle closer 8 is mounted on bracket 11 which is pivotably mounted on axis 10 to the engine or carburetor. Bracket 11 is also provided with ferromagnetic portion 12 which engages electromagnet 13. Electromagnet 13 is wired to battery 15 through ignition switch 14.

In one embodiment of the invention, spring 16 is not provided. When throttle flap 2 is opened by activation of linkage 4, bracket 11 will fall into a position wherein ferromagnetic portion 12 engages electromagnet 13. If ignition switch 14 is closed, magnet 13 will retain bracket 11 at a position wherein plunger 7 engages the extended arm of linkage 4. Throttle closer 8 will then be operative to restrain the closing of flap 2 when linkage 4 is released to move into the closed throttle position. When ignition switch 14 is opened to shut off the engine, bracket 11 is no longer held by magnet 13 and moves into the position illustrated, whereby throttle flap 2 is allowed to reach its fully closed position. The motion of bracket 11 in this case may be under the force of a throttle closing spring 18.

In an alternate embodiment there is provided spring 16 which is positioned between a portion of the engine 17 and throttle closer 8. Spring 16 provides a force for moving bracket 11 and closer 8 out of the linkage engaging position. In this embodiment the force of electromagnet 13 must be sufficient to move bracket 11 against the force of spring 16.

It will be recognized that in either arrangement, the moving of the closer mechanism into and out of a position to restrain the closing of the throttle flap enables proper throttle closing operation while the engine is running, and a rapid and complete closing of the throttle flap 2 when the ignition switch is turned off.

Those skilled in the art will recognize that instead of the pivoting mounting illustrated in the drawing, a sliding mounting for throttle closer 8 may be used to accomplish the same result.

While there have been described what are believed to be the preferred embodiments of the invention, those skilled in the art will recognize that other and further modifications may be made thereto without departing from the spirit of the invention, and it is intended to claim all such embodiments as fall within the true scope of the invention.

I claim:

1. A throttle closing mechanism for use in conjunction with an internal combustion engine having an ignition switch, comprising:

throttle linkage, connected to a throttle flap, and moveably mounted with respect to said engine to open and close said throttle flap;

a throttle closer, comprising a housing and a plunger, said housing mounted to said engine and moveable into and out of a position wherein said plunger engages said linkage prior to the closing of said flap;

and an electromagnet, activated by said ignition switch, for holding said housing in said position.

2. A throttle closing mechanism as specified in claim 1 wherein the force of said electromagnet is sufficient only to retain said housing in said position and wherein said housing is arranged to move into said position upon opening of said throttle.

3. A throttle closing mechanism as specified in claim 1 wherein there is provided a spring urging said housing out of said position when said electromagnet is deactivated.

4. A throttle closing mechanism as specified in claim 3 wherein said spring is additionally arranged to close said throttle flap.

5. A throttle closing mechanism as specified in claim 1 wherein said housing is mounted on a pivotable bracket.

6. A throttle closing mechanism as specified in claim 5 wherein said bracket is pivoted at one end and engages said electromagnet at an opposite end.

* * * * *